US012226682B2

(12) United States Patent
Holman et al.

(10) Patent No.: US 12,226,682 B2
(45) Date of Patent: Feb. 18, 2025

(54) SWING MOTION TRAINER

(71) Applicant: Back Story, LLC, Aspen, CO (US)

(72) Inventors: Peter Holman, Aspen, CO (US); Jon Levy, Superior, CO (US); Jeremy James, Snowmass Village, CO (US)

(73) Assignee: Back Story, LLC, Aspen, CO (US)

( * ) Notice: Subject to any disclaimer, the term of this patent is extended or adjusted under 35 U.S.C. 154(b) by 0 days.

(21) Appl. No.: 18/375,624

(22) Filed: Oct. 2, 2023

(65) Prior Publication Data

US 2024/0173604 A1 May 30, 2024

Related U.S. Application Data

(63) Continuation of application No. 17/847,467, filed on Jun. 23, 2022, now Pat. No. 11,771,975, which is a continuation-in-part of application No. 17/705,384, filed on Mar. 27, 2022, now abandoned.

(60) Provisional application No. 63/166,519, filed on Mar. 26, 2021.

(51) Int. Cl.

| | |
|---|---|
| ***A63B 69/36*** | (2006.01) |
| ***A63B 53/12*** | (2015.01) |
| ***A63B 60/10*** | (2015.01) |
| *A63B 53/04* | (2015.01) |
| *A63B 102/32* | (2015.01) |

(52) U.S. Cl.

CPC ..... *A63B 69/3632* (2013.01); *A63B 53/12* (2013.01); *A63B 60/10* (2015.10); *A63B 2053/0491* (2013.01); *A63B 2102/32* (2015.10)

(58) Field of Classification Search

CPC ..... A63B 69/3632; A63B 53/12; A63B 60/10; A63B 2053/0491; A63B 2102/32

USPC ..... 473/206, 219, 229, 232, 234, 242, 256, 473/298, 299, 520, 558

See application file for complete search history.

(56) References Cited

U.S. PATENT DOCUMENTS

| | | | | | |
|---|---|---|---|---|---|
| 1,930,342 | A * | 10/1933 | Graham | A63B 69/3632 | 482/109 |
| 3,743,297 | A * | 7/1973 | Dennis | A63B 15/00 | 482/109 |
| 4,602,788 | A * | 7/1986 | Wendt | A63B 15/00 | 482/109 |
| 4,982,963 | A * | 1/1991 | Fazio | A63B 15/00 | 473/223 |
| 5,599,021 | A * | 2/1997 | Lary | A63B 15/00 | 482/92 |
| 5,807,183 | A * | 9/1998 | Benson | A63B 60/10 | 473/232 |
| 6,910,973 | B2 * | 6/2005 | Kuster | A63B 21/0552 | 473/258 |

(Continued)

*Primary Examiner* — Nini F Legesse
(74) *Attorney, Agent, or Firm* — Blank Rome LLP

(57) ABSTRACT

A swing motion trainer used to simulate one or more sport swing movements includes a rod portion comprising a shaft with a grip. The swing motion trainer includes a resistance portion comprising an interchangeable mechanism at a distal end of the rod portion, the resistance portion includes an interchangeable mechanism at the distal end of the rod portion, wherein the interchangeable mechanism is configured to attach a removable resistance element to the distal end of the rod portion. The removable resistance element that is attachable to the distal end of the rod portion via the interchangeable mechanism. The removable resistance element provides a resistance to a swinging motion of the swing motion trainer.

19 Claims, 8 Drawing Sheets

FIG. 1A

(56) References Cited

U.S. PATENT DOCUMENTS

| | | | | |
|---|---|---|---|---|
| 8,192,335 | B2 | 6/2012 | Pullaro | |
| 10,912,979 | B1 * | 2/2021 | Gathright | A63B 15/00 |
| 11,771,975 | B2 * | 10/2023 | Holman | A63B 21/0088 473/409 |
| 2014/0141943 | A1 | 5/2014 | DiPace et al. | |

* cited by examiner

SWING MOTION TRAINER

CLAIM OF PRIORITY

This application is a continuation of U.S. patent application Ser. No. 17/847,467, filed Jun. 23, 2022, now U.S. Pat. No. 11,771,975, which is a continuation-in-part of U.S. patent application Ser. No. 17/705,384, filed Mar. 27, 2022, now abandoned.

U.S. patent application Ser. No. 17/705,384 claims priority to U.S. Provisional Pat. Application No. 63/166,519, filed on 26 Mar. 2021, and titled SWING MOTION TRAINER. The entire contents of the aforementioned patent applications are hereby incorporated by reference.

BACKGROUND

Golf is a game that requires various attributes. These can include: strength, speed, power, control, balance, and accuracy. Accordingly, development of these qualities often requires significant amounts of "off course" conditioning for optimal performance and durability. There are many devices that are designed to improve swing speed or strength for the golf swing. However, there are no devices that are designed to enhance both swing speed and strength for golf. Accordingly, improvements to golf swing training devices are desired.

SUMMARY OF THE INVENTION

A swing motion trainer used to simulate one or more sport swing movements includes a rod portion comprising a shaft with a grip. The swing motion trainer includes a resistance portion comprising an interchangeable mechanism at a distal end of the rod portion, the resistance portion includes an interchangeable mechanism at the distal end of the rod portion, wherein the interchangeable mechanism is configured to attach a removable resistance element to the distal end of the rod portion. The removable resistance element that is attachable to the distal end of the rod portion via the interchangeable mechanism. The removable resistance element provides a resistance to a swinging motion of the swing motion trainer.

Figures 1, 1A:
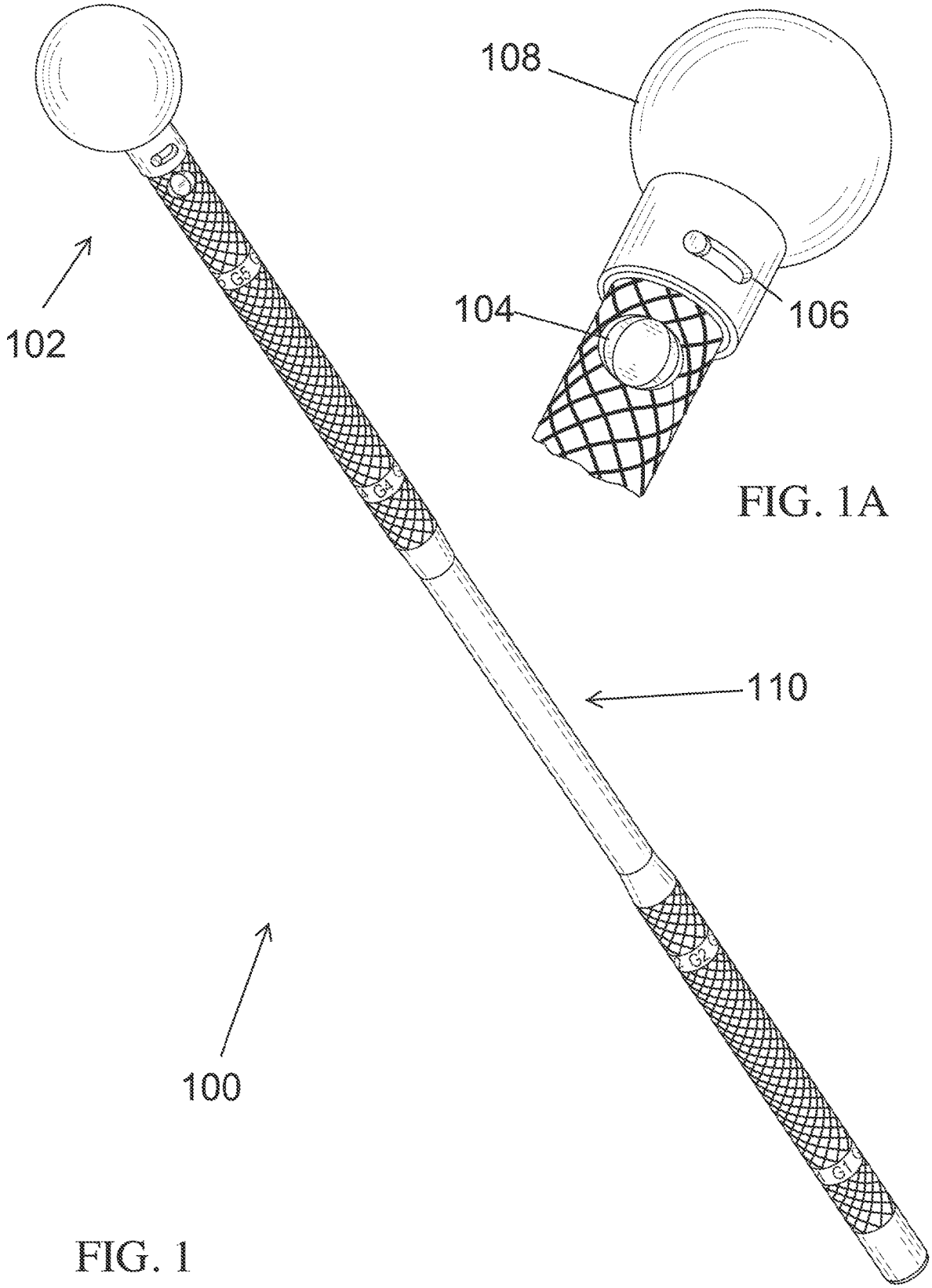
FIGS. 1 and 1A illustrate an example swing motion trainer, according to some embodiments.

The Figures described above are a representative set and are not exhaustive with respect to embodying the invention.

DESCRIPTION

Disclosed are a system, method, and article of implementing swing motion trainer. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to 'one embodiment,' 'an embodiment,' 'one example,' or similar language means that a particular feature, structure, or characteristic described in connection with the embodiment is included in at least one embodiment of the present invention. Thus, appearances of the phrases 'in one embodiment,' 'in an embodiment,' and similar language throughout this specification may, but do not necessarily, all refer to the same embodiment.

Furthermore, the described features, structures, or characteristics of the invention may be combined in any suitable manner in one or more embodiments. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Definitions

Example definitions for some embodiments are now provided.

Polyoxymethylene (POM), also known as acetal, polyacetal, and polyformaldehyde, is an engineering thermoplastic used in precision parts requiring high stiffness, low friction, and excellent dimensional stability. As with many other synthetic polymers, it is produced by different chemical firms with slightly different formulas and sold variously by such names as Delrin®, etc.

Eye bolt is a bolt with a loop at one end. An eye bolt can be used to firmly attach a securing eye to a structure, so that a band (e.g. a flexible element with tensile strength) can be attached to it.

Carbon fiber can be reinforced polymer is a strong and light fiber-reinforced plastic which contains carbon fibers (e.g. fibers of about 5 to 10 micrometers in diameter and composed mostly of carbon atoms).

Chuck can be a clamp which securely holds a removable part.

Polyvinyl chloride (PVC) is synthetic plastic polymer.

Example Embodiments

A swing motion trainer is disclosed. The swing motion trainer can be used, inter alia, to improve swing speed and power for golfers. The swing motion trainer can be used to strengthen muscles involved with the golf swing. The swing motion trainer can use multiple attachments that are easily changed between an interface and a shaft of the rod portion of the swing motion trainer. These attachments can include, inter alia: weighted balls, resistance cord, fan mechanism, etc. In this way, the swing motion trainer can be versatile tool in the golf training space. For example, when users employ the resistance cord option of the swing motion trainer, the user pushes through various rotational loads which disrupt balance and posture. This motion can activate the core musculature which is imperative for golf performance and durability. When users employ any one of the weighted balls or the fan resistance mechanism of the swing motion trainer, the user is faced with resistance during the mechanics of the swing pattern.

In the case of the fan, there is resistance on both the back swing and towards the impact position challenging the swing in both directions. In the case of the weighted balls there is resistance on the backswing and added acceleration towards impact position; thus challenging or overloading the backswing while accelerating the device towards the impact position of the swing. Various example embodiments of the swing motion trainer are now discussed.

FIG. 1 illustrates an example swing motion trainer 100, according to some embodiments.

As shown, swing motion trainer 100 can include a rod portion 110 and a resistance portion 102. The resistance portion 102 can be removable/interchangeable between various weights and/or resistance systems. For example, as shown, resistance portion 102 can be an interchangeable mechanism at the distal end of the rod portion 110 (e.g. elements 104-018 discussed infra, etc.). The swing motion trainer 100 can allow for three-hundred and sixty (360) degrees rotation. The rod portion 110 can have a rubber coating such that it does not harm golf clubs when stored in a golf bag.

In one shown example, the resistance portion 102 can be a weighted ball attachment 108. Weighted ball attachment 108 can be removable. Weighted ball attachment 108 can be weighted rubber, steel, weight plastic, hard foam, and/or various combinations thereof, etc. There can be several weights for progressing/regressing resistance. These can be attachable weighted balls, attachable weighted axe/hammer heads, attachable elastic bands, etc. Weighted ball attachment 108 can be a sphere, cylinder, cube, other three-dimensional geometric shapes, etc. according to various embodiments. The weight of the weighted ball attachment 108 can be varied to configure swing motion trainer 100 to match the swing weights of various golf clubs (e.g. D2-D5, etc.). In one example, a D2 weight can mean 76 raw shaft weight grams/71.5 cut shaft weight grams, D3 can mean 83 raw shaft weight grams/78.0 cut shaft weight grams; D4 can mean 90 raw shaft weight grams/84.5 cut shaft weight grams; D5 can mean 97 raw shaft weight grams/91.0 cut shaft weight grams; etc. The D3 Weighted Version of the ball attachment can be 70 grams in weight. However, heavier ball attachments can range from 100 grams to 125 grams in some examples.

Figure 2:
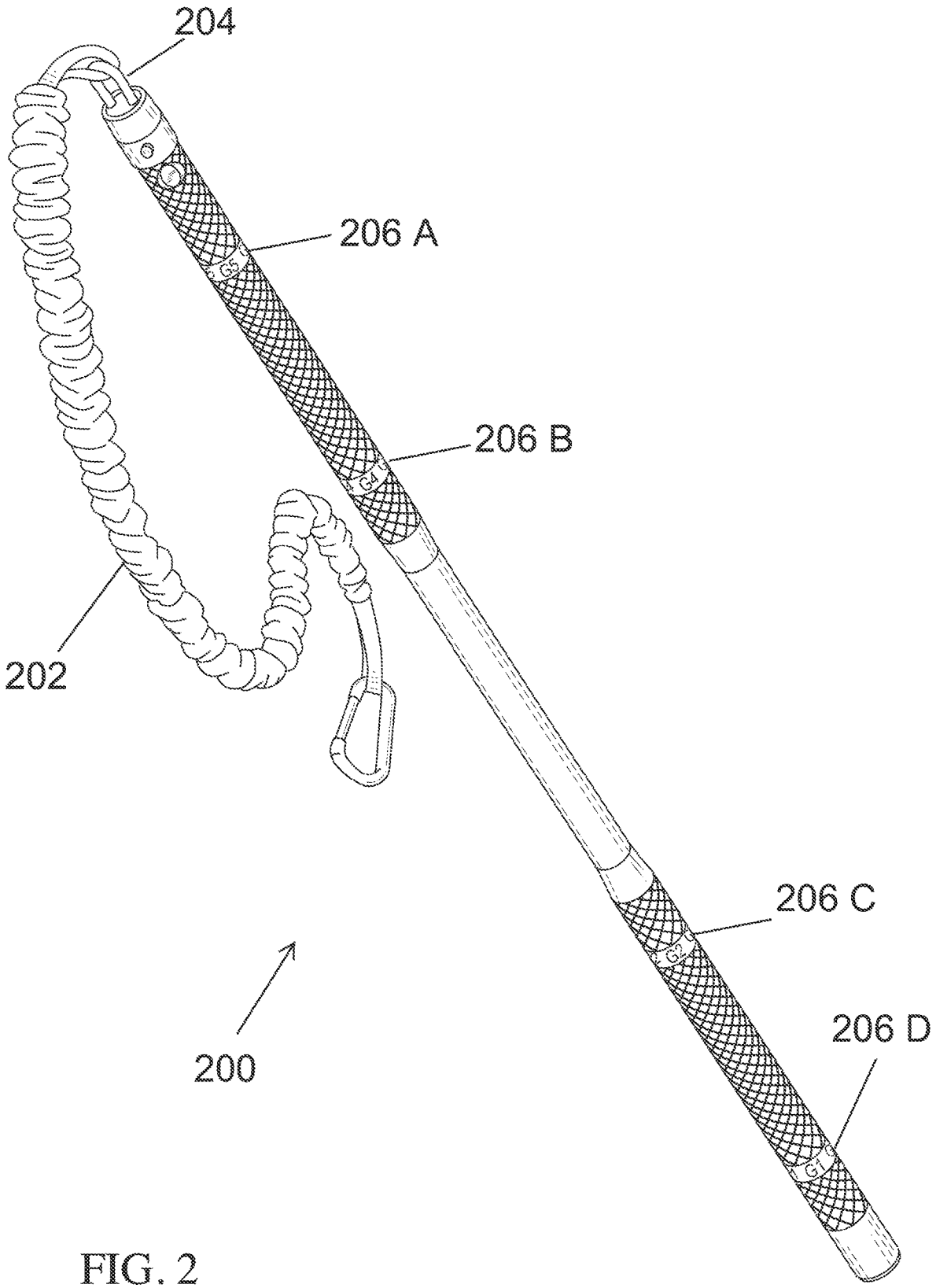
FIG. 2 illustrates an example swing motion trainer with an elastic resistance attachment, according to some embodiments.

For example, in another shown example (e.g. see FIG. 2), the resistance portion can include an elastic resistance attachment 202. Several different resistance levels for progressing/regressing resistance by way of various elastic resistance attachments.

In yet another example (not shown), the resistance portion can be a fan resistance mechanism. The fan can dynamically increase resistance as the user swings with more force. The fan can provide an auditory experience (e.g. creating a woosh sound, siren, clicking sounds, etc.). In this way, the user can be provided auditory feedback on the speed of the swinging motion. The fan can increase air resistance that slows the swing down unless the user increases applied force. In one example, the fan can have a cylindrical pattern (e.g. a ball shape that has fans in a cylindrical pattern around it).

As shown in FIG. 1, swing motion trainer 100 can be used to simulate the action by which players hit the ball in a golf swing. However, it is noted that swing motion trainer 100 can be used to simulate other sport swing movements (e.g. back-swing, downswing, or upswing, etc.). The swing motion trainer 100 can also be used to simulate various golf stroke types (e.g. chip, pitch, putt, etc.). Additionally, the variables of swing (e.g. grip and position of user's fingers, position, and movement of user's feet, etc.) can be varied as well. The swing motion trainer 100 can be used for warm up drills and/or resistance-based strengthening exercises.

Swing motion trainer 100 can have the grips located in specified locations. In one example, the grip can be an actual golf grip (e.g. leather or leather-like synthetic, etc.). The grip can be a PVC rubberized handle as well (e.g. similar to a motocross grip, etc.). Other types of grip material (e.g. hard foams, leather, etc.) can be utilized.

Rod portion 110 can be a shaft with a grip. Rod portion 110 can be an aluminum bar (e.g. with a partially hollow aluminum shaft, etc.) and/or other similar composite material. In some examples, rod portion 110 can be composed of carbon fiber. The rod portion 100 can be partially hollow. This can make it lightweight, so the user can swing with speed. Rod portion 110 can be of a similar length to a golf club (e.g. at least 18 inches long, and no more than 48 inches, etc.). In some examples, rod portion 110 can have a balance point with the bar itself, such that it mimics the feel and handle of a golf club. Rod portion 110 can have a cap such that varied weighted cylinders can be inserted into the bar to increase the load of the rod portion 110. This weight can be varied according to the placement of the varied weighted cylinders or can be a uniform arrangement of weighted cylinders. The cylinders can be shorter than the rod portion 110 such that a plurality of cylinders can be inserted in various orders to change the balance.

FIG. 1A illustrates an example attachment mechanism (104-106) for a swing motion trainer 100, according to some embodiments. It is noted that in other example embodiments, other attachment mechanisms (e.g. magnets, other types of interlocking mechanisms, etc.) can be utilized in lieu and/or in combination to the presently shown attachment mechanism 104-106. Attachment mechanism 104-106 can include a connecting mechanism interlock, a depressible button 104 that is spring loaded with a cross pin, and a swiveling eye bolt 204 with two slot elements. Depressible button 104 can be pressed to interchange a head. Lock position and free position based. When attachment mechanism 104-106 is in a locked position head (e.g. ball 108, etc.) remains in place. When attachment mechanism 104-106 is in a free position, the head is free to be displaced from the swing motion trainer 100. As noted supra, other heads than ball 108 can be attached so can attached, inter alia, a resistance cord through a carabiner (e.g. carabiner 602, door attachments, looping mechanisms, kite-type attachments, etc.) or other heads (e.g. hammer head, mace heads of varying weights, etc.).

Attachment mechanism 104-106 can include a spring-loaded mechanism that is unlocked/locked with a spring-loaded mechanism. Inserting and turning the head into the attachment mechanism can click the head into place and hold it in a locked position. Button 104 can be pressed in a locked position to then place the head in an unlocked position.

Ball 108 can be composed of a dense foam, Delrin®, hard plastic, etc. Ball 108 can be any material that can be molded into a spherical shape. Balls can be of varying weights and colors (e.g. color used to indicate ball weight).

Swing motion trainer 100 can have a sleeve comprising an elastic polymer tubing. The shaft of swing motion trainer 100 can have demarcations 206 A-D to mark hand positions.

Figure 3:
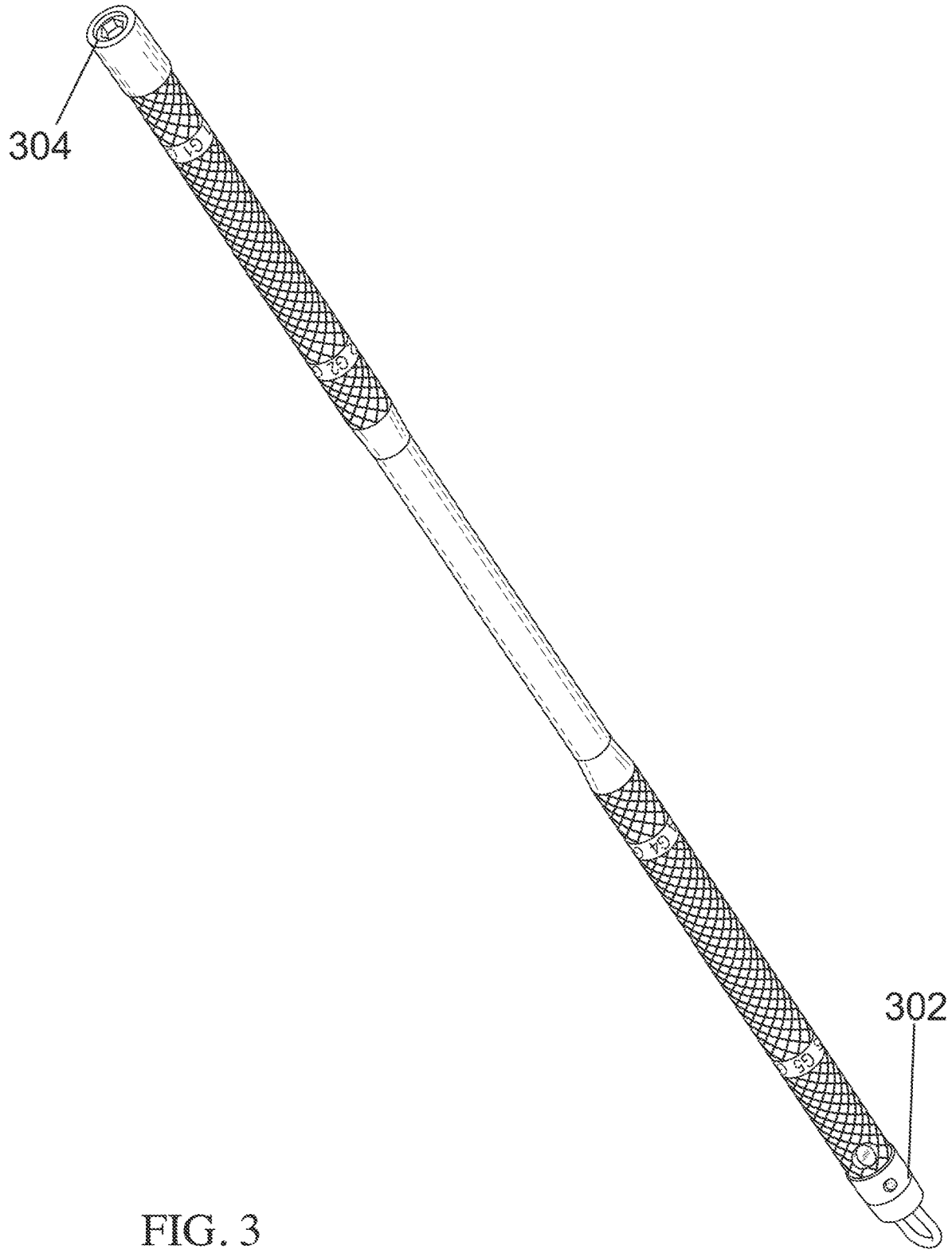
FIG. 3 illustrates another example view of a swing motion trainer, according to some embodiments.
Figures 4A, 4B, 4C, 4D:
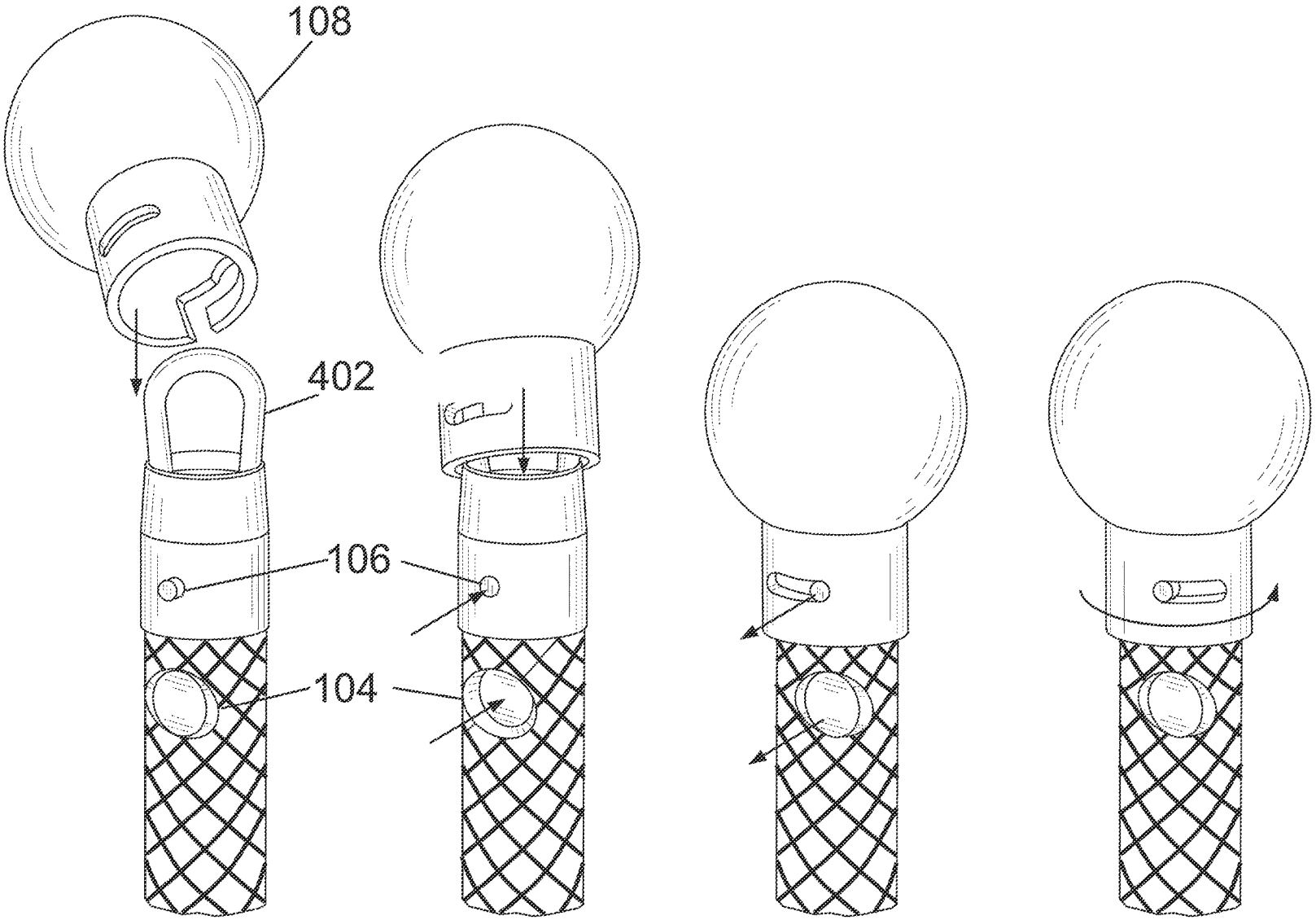
FIGS. 4A-D illustrates an example attachment of a ball to an attachment mechanism of a swing motion trainer, according to some embodiments.

FIG. 3 illustrates another example view of a swing motion trainer 100, according to some embodiments. As shown, attachment mechanisms can be at both ends in some examples. Proximate end 304 can include an Allen head (e.g. hex head) screw fixture for attached an eye bolt (e.g. similar to eye bolt 204 of distal end 302) to connect resistance cords on both ends for performing various resistance exercises.

It is noted that, in some embodiments, swing motion trainer 100 can include various electronic sensors for tracking various motion-related variables of a user swing. These can include motion tracking sensors and speed tracking sensors, etc. such as gyroscopes, accelerometers, etc. These sensors can be communicatively coupled with one or more local computers, power sources and/or local computing networks (e.g. Bluetooth®, etc.). The data from these sensors can be uploaded to an external computer system for position analysis and motion analysis by a user, coach, etc. For example, sensors can be used to provide information. This can be used to quantify the resistance in the swinging motion. A user can input information about the weight of ball attachments, the resistance level of an elastic band attachment, etc. User motions (e.g. in three spatial dimensions, swing speed at various location, swing velocity at various locations, etc.), repetitions, resistance levels, etc. can be communicated to a swing trainer application for analysis and viewing. This information can also be stored for later access. Users can compare/compete with pre-set work outs, other users, past work outs, etc. Duration.

For attachments, the swing motion trainer 100 can utilize various interchangeable mechanisms. For example, swing motion trainer 100 can have a push button that depresses to disengage a head of an attachment. In another example, the swing motion trainer 100 can have a pull tab that pulls to disengage the attachment. This can be an air chuck type system. In yet another example, a toggle lever can be utilized.

In one example, the rod portion 110 can telescope to minimize its size for travel or breaks in half almost like. In this way, the length of the swing motion trainer 100 can be adjusted. In some examples, a contoured grip that mimics a golf handle can be used. Additionally, the rod portion 110 can be designed to bend slightly during the swing motion. In one embodiment, the rod portion can be 44.5" long and 890 grams when the standard D3 ball is attached.

The rod portion 110 can also include various coaching markings on the handles. The handles can be divided by a white vertical or circumferential markings. For example, specified grip zones can be marked such that a coach can communicate a preferred grip location or type.

It is noted that swing motion trainer 100 can be a multi-sport training device. Accordingly, aspects of swing motion trainer 100 can be modified for other sports than golf training. For example, the rod dimensions and length can be modified to adapt the swing motion trainer 100 for training such movements as: a tennis racket swing, a baseball bat swing, a cricket bat swing, a badminton racket swing, martial art weapons swing, etc. Aspects of swing motion trainer 100 can be modified for mimicking various specified sports movements, exercise movements, physical therapy movements, occupational movements, other movement patterns, etc.

FIGS. 4A-D illustrate an example attachment of a ball 108 to an attachment mechanism of a swing motion trainer 100, according to some embodiments. The attachment of ball 108 can be at the at the distal end 302 of swing motion trainer 100.

Figure 5:
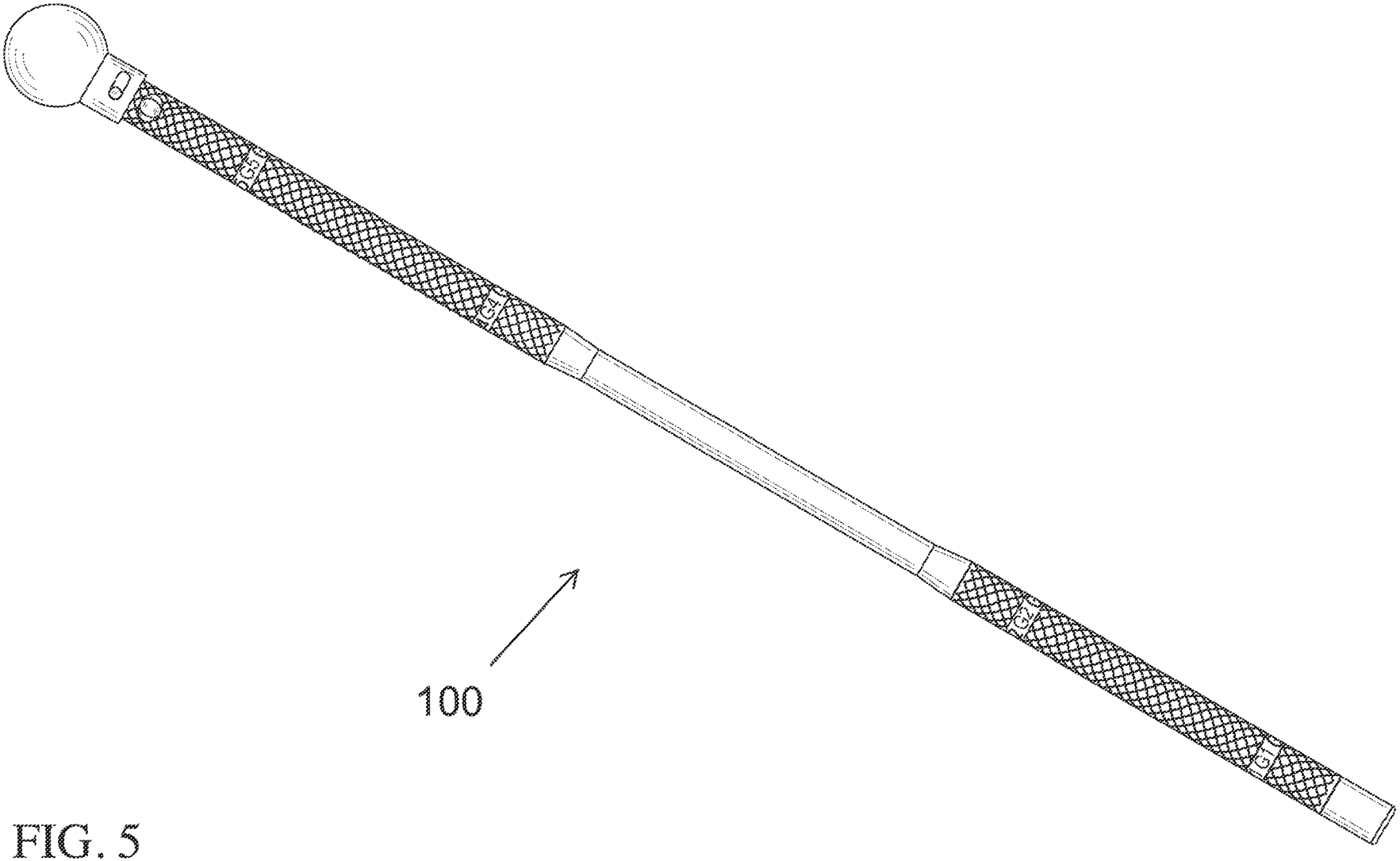
FIG. 5 illustrates another example view of a swing motion trainer, according to some embodiments.

FIG. 5 illustrates another example view of a swing motion trainer 100, according to some embodiments.

Figure 6:
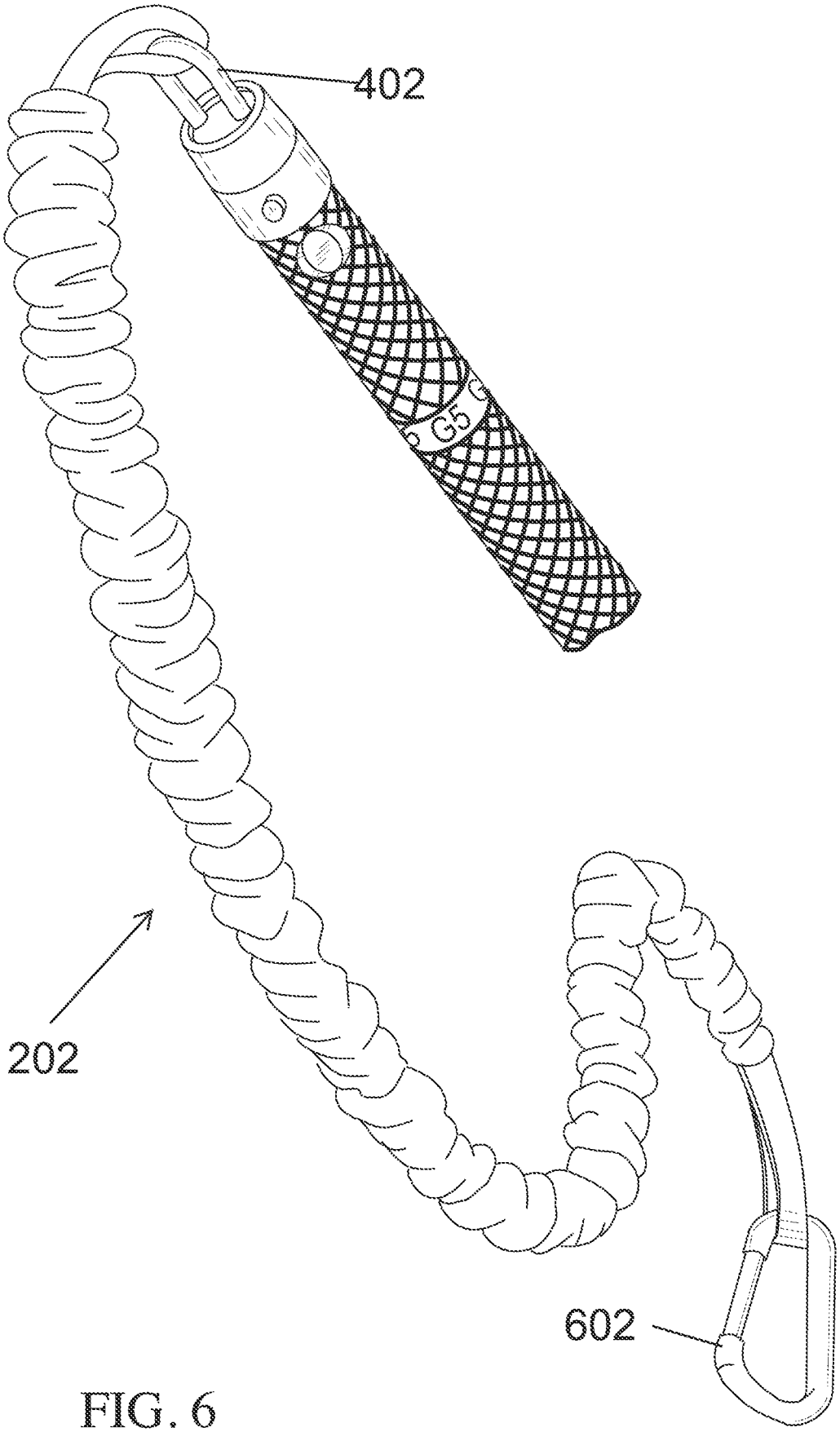
FIG. 6 illustrates an example resistance band system, according to some embodiments.

FIG. 6 illustrates an example resistance band system, according to some embodiments. The resistance band 202 can be composed (in part) of an elastic material. For example, the resistance band can include an elastic polymer tubing. In one example, the resistance band can be looped around a tree (or similar structure). A carabiner 602 can connect to the cord itself to fix around any kind of tree, railing, etc. Alternatively, the resistance band can include a carabiner 602, bolt snap, and the like, at one end. In this way, the resistance band can be a chain link fence, pole, door, etc. The resistance band can enable higher-tension loads to train for time under tension; strength training; core-muscle activation; etc. along with the swing motion training component. Alternatively, the resistance band 202 can enable a user to swing with higher velocities. In this way, the resistance band embodiment can be used for training a golf swing. Several resistance bands of varying resistance can be provided. The resistance band can be used for isometric exercises and/or balance exercises.

Figure 7:
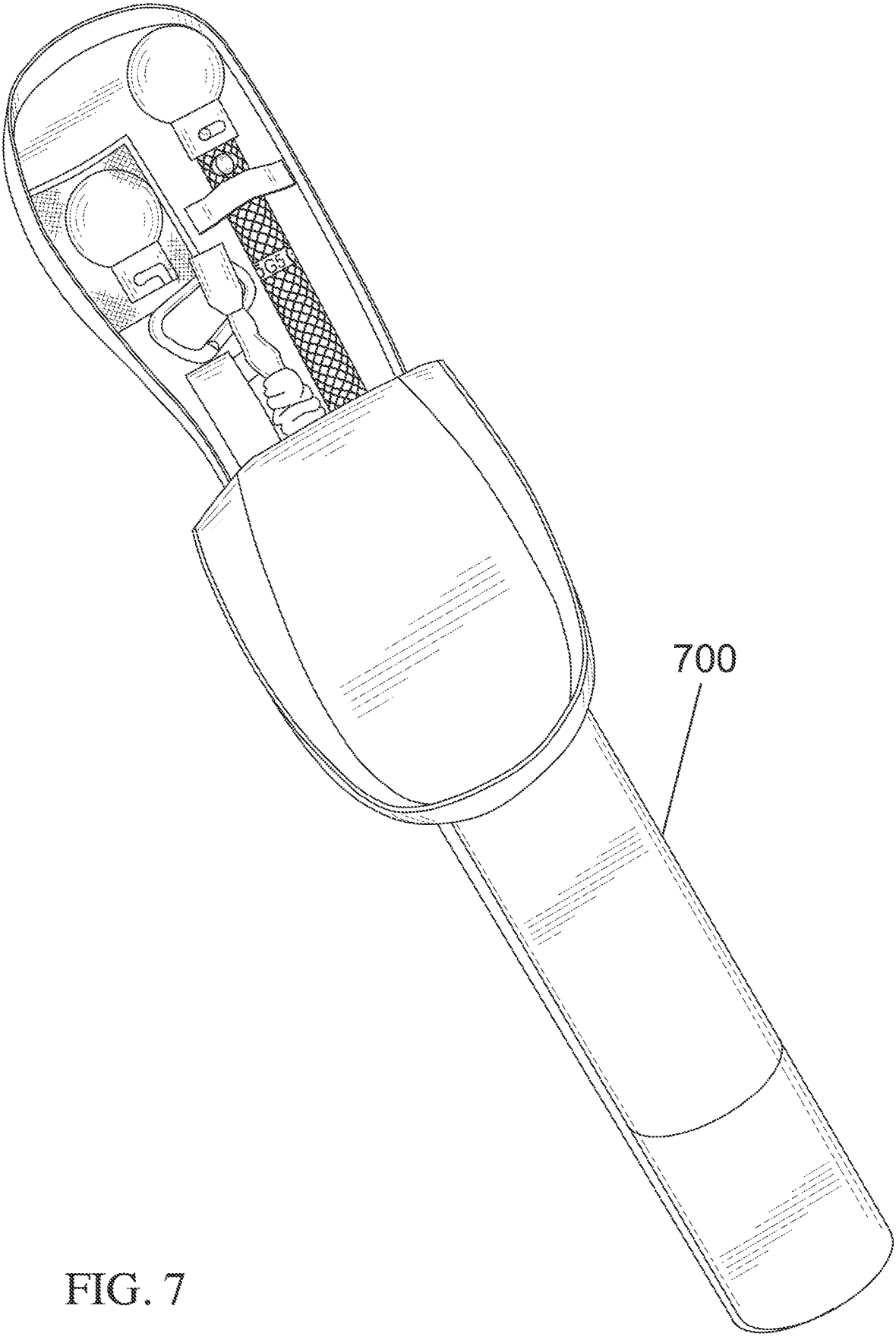
FIG. 7 illustrates an example swing motion trainer stored in a storage bag, according to some embodiments.

FIG. 7 illustrates an example swing motion trainer 100 stored in a storage bag 700, according to some embodiments. Storage bag 700 can include separate compartments for storage of various items associated with a swing motion trainer 100.

Figure 8:
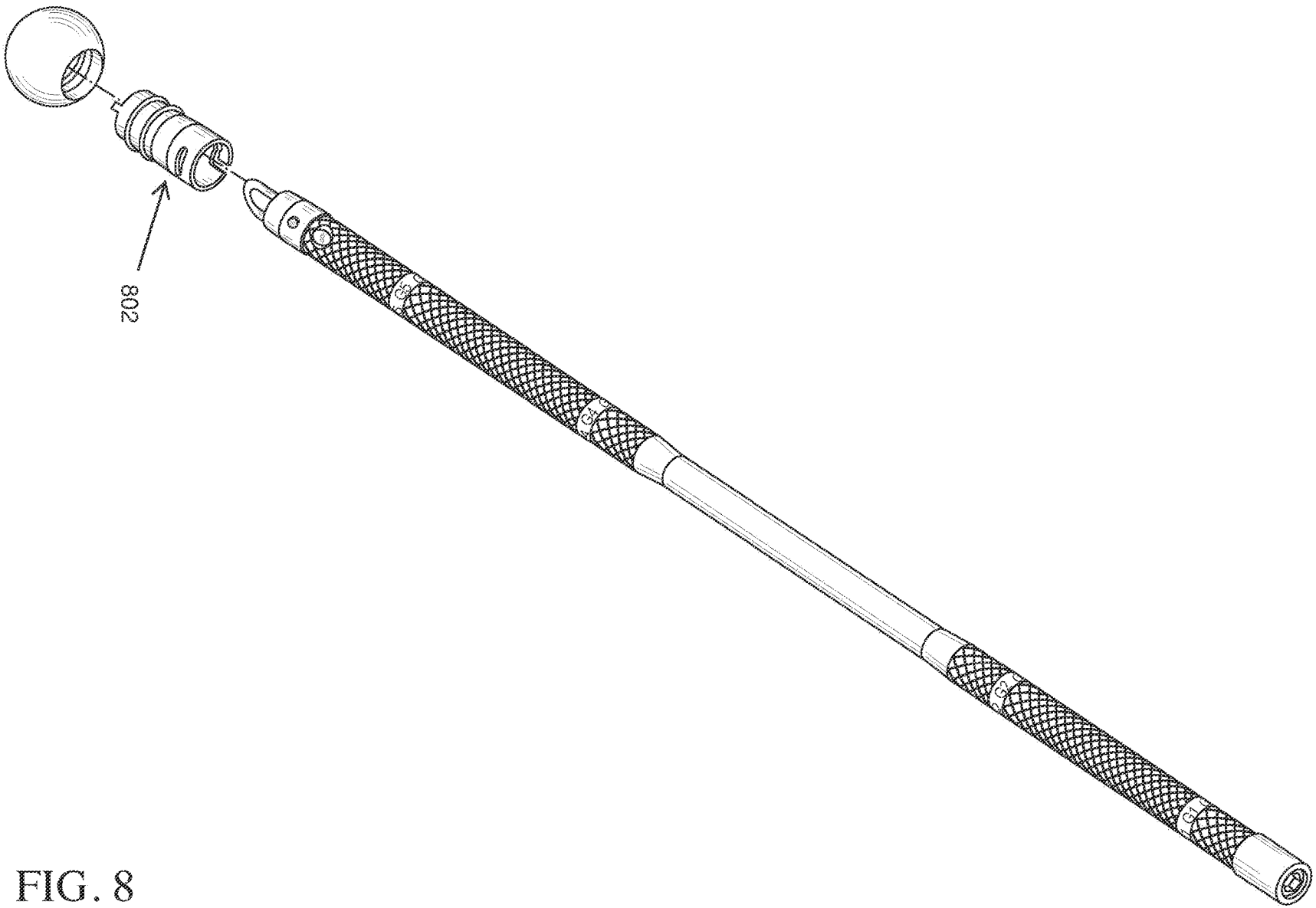
FIG. 8 illustrates an example of a connection point device between the ball and the actual housing of bar itself, according to some embodiments.

FIG. 8 illustrates an example of a connection point device between the ball and the actual housing of bar itself, according to some embodiments. This connection point device 802 is fixed to each ball 108. For example, the corkscrew component shown is housed within each detachable ball 108 using an adhesive. The ball 108 with connection component 802 can then be attached and/or removed from the bar by pressing the button 104. This activates the pin (of attachment mechanism 104-106, etc.) to change from an unlocked position to a locked position.

CONCLUSION

Although the present embodiments have been described with reference to specific example embodiments, various modifications and changes can be made to these embodiments without departing from the broader spirit and scope of the various embodiments. Accordingly, the specification and drawings are to be regarded in an illustrative rather than a restrictive sense.

What is claimed as new and desired to be protected by Letters Patent of the United States is:

1. A swing motion trainer configured to simulate one or more sport swing movements, the swing motion trainer comprising:

a rod portion having a grip;

a weighted ball attachment configured to be attached to a distal end of the rod portion;

an elastic band configured to be attached to the distal end of the rod portion; and a connection member configured to attach the elastic band to the distal end of the rod portion, wherein the weighted ball attachment and the elastic band are interchangeably attachable to the distal end of the rod portion.

2. The swing motion trainer of claim 1, wherein the weighted ball attachment has a geometric shape of a sphere, a cylinder, or a cube.

3. The swing motion trainer of claim 1, wherein the weighted ball attachment is configured to be locked to the distal end of the rod portion.

4. The swing motion trainer of claim 3, further comprising a depressible button configured to unlock the weighted ball attachment.

5. The swing motion trainer of claim 3, wherein the weighted ball attachment is configured to be removed when the weighted ball attachment is in an unlocked position.

6. The swing motion trainer of claim 1, wherein the rod portion is composed of a partially hollow aluminum shaft.

7. The swing motion trainer of claim 6, wherein the rod portion comprises a rubber coating.

8. The swing motion trainer of claim 1, further comprising a second weighted ball attachment configured to be attached to the distal end of the rod portion, wherein:

the rod portion has a length and a dynamic feel of a golf club at a D3 swing weight when the weighted ball attachment is attached to the distal end of the rod portion, and the rod portion has an overloaded feel of the golf club when the second weighted ball attachment is attached to the distal end of the rod portion.

9. The swing motion trainer of claim 1, wherein the rod portion comprises a plurality of marked grip zones that indicate a plurality of grip locations.

10. The swing motion trainer of claim 1, wherein a proximal end of the rod portion comprises a hex head screw fixture and an eye bolt, configured to attach to a second elastic band.

11. The swing motion trainer of claim 1, wherein the connection member comprises an eye bolt.

12. The swing motion trainer of claim 11, wherein the elastic band includes a loop received through the eye bolt.

13. The swing motion trainer of claim 1, wherein the connection member extends distally of the distal end of the rod portion.

14. The swing motion trainer of claim 1, wherein the connection member is configured to attach to the distal end of the rod portion with a threaded connection.

15. The swing motion trainer of claim 1, wherein the elastic band comprises an elastic polymer tubing.

16. The swing motion trainer of claim 1, further comprising a carabiner attached to a distal end of the elastic band.

17. The swing motion trainer of claim 1, further comprising a second elastic band of a resistance different than the elastic band.

18. The swing motion trainer of claim 1, wherein the weighted ball attachment is configured to be attached to the distal end of the rod portion through rotation.

19. The swing motion trainer of claim 1, further comprising a storage bag receiving the rod portion, the weighted ball attachment, the elastic band, and the connection member.

* * * * *